US005772363A

United States Patent [19]

Larson

[11] Patent Number: 5,772,363

[45] Date of Patent: Jun. 30, 1998

[54] PILING REMOVER

[76] Inventor: John G. Larson, 378 E. 23rd St., Chico, Calif. 95928

[21] Appl. No.: 760,729

[22] Filed: Dec. 5, 1996

[51] Int. Cl.[6] ..... E02D 37/00

[52] U.S. Cl. ..... 405/232; 111/101; 124/23.1; 166/55.6; 405/256; 405/303

[58] Field of Search ..... 405/232, 231, 405/246, 247, 303; 254/199, 220; 111/101; 173/140, 185, 44; 166/55, 55.6; 52/514; 124/23.1

[56] References Cited

U.S. PATENT DOCUMENTS

| | | | |
|---|---|---|---|
| 111,221 | 1/1871 | Luther | 166/55.6 |
| 3,763,654 | 10/1973 | Matsushita | 405/232 |
| 4,180,047 | 12/1979 | Bertelson | 405/232 X |
| 4,248,550 | 2/1981 | Blaschke et al. | 405/232 |
| 4,367,056 | 1/1983 | Seneviratne | 405/232 X |
| 4,602,444 | 7/1986 | Endo | 111/101 |
| 4,676,013 | 6/1987 | Endo | 111/101 |
| 4,979,489 | 12/1990 | Abbasov et al. . | |

*Primary Examiner*—Dennis L. Taylor

[57] ABSTRACT

A pile remover has a first embodiment for removal of short pilings and a second embodiment for long pilings. Both embodiments include a pile-fitting tube with hydraulic cylinders at the top end of the tube that push downward to cause rocking cutters at the bottom end of the tube to pivot with sharpened ends moving inward to shear off the piling. Both embodiments are designed for use with a back hoe or a derrick. After a piling has been shearing, with the cutters still in cut position, the back hoe operator can lift the cut off piling and deposit it on a barge or other conveyance by reversing the cutter action and drooping the piling.

4 Claims, 3 Drawing Sheets

PILING REMOVER

BACKGROUND OF THE INVENTION

1. Field of the Invention

This invention relates to devices for shearing off and removing old pilings. The present invention is particularly directed towards an adjustable tube fitting over an old piling with shearing mechanics on the tube.

2. Description of the Prior Art

Although several types of machines for shearing off logs are seen in past art patents, none of the devices appeared to be directly similar to the present invention. Most types of cutters and shears are for removal of land trees. Shearing or cutting equipment directed particularly at the removal of old pilings does not appear to be disclosed in past art patents and devices for the purpose are not readily available in the market place.

SUMMARY OF THE INVENTION

Therefore, in practicing my invention, I provide a devices for shearing off and removing old pilings with shearing mechanics on a tube that fits over the piling. The upper end, the tube has attachments for being lifted and operated by auxiliary equipment like a back hoe or a derrick on a barge. Hydraulic cylinders arranged around an upper section of the tube activated by the back hoe operator to and having mechanics useful with a back hoe or a derrick.

Push downward to cause rocking cutters at the bottom end of the tube to pivot with sharpened ends moving inward to shear off the piling. After shearing, with the cutters still in cut position, the back hoe operator can lift the cut off piling and deposit it on a barge or other conveyance by reversing the cutter action and drooping the piling. With the cutters in the open position, the operator swings the empty tube around and over the next piling to be cut and removed. A first embodiment of the invention is provided for short pilings. A second embodiment has telescoping tubing and is designed for the removal of longer pilings.

As a principal object, the present invention provides a piling remover in two embodiments, one for short pilings and one for long pilings.

Another object of the invention is to provide a piling remover having shearing and cutting mechanics in a tube that will fit over the piling to be removed.

A further object of my invention is to provide a piling remover attachable Other objects and the many advantages of the present invention will become apparent from reading descriptions of numbered parts in the specification and comparing them with like numbered parts shown in the included drawings.

BRIEF DESCRIPTION OF THE DRAWINGS

In the drawings:

FIG. 3 showing a bottom section of the encasement tube enlarge to illustrate the openings for the cutters to pass through.

DESCRIPTION OF THE PREFERRED EMBODIMENT

Figure 1:
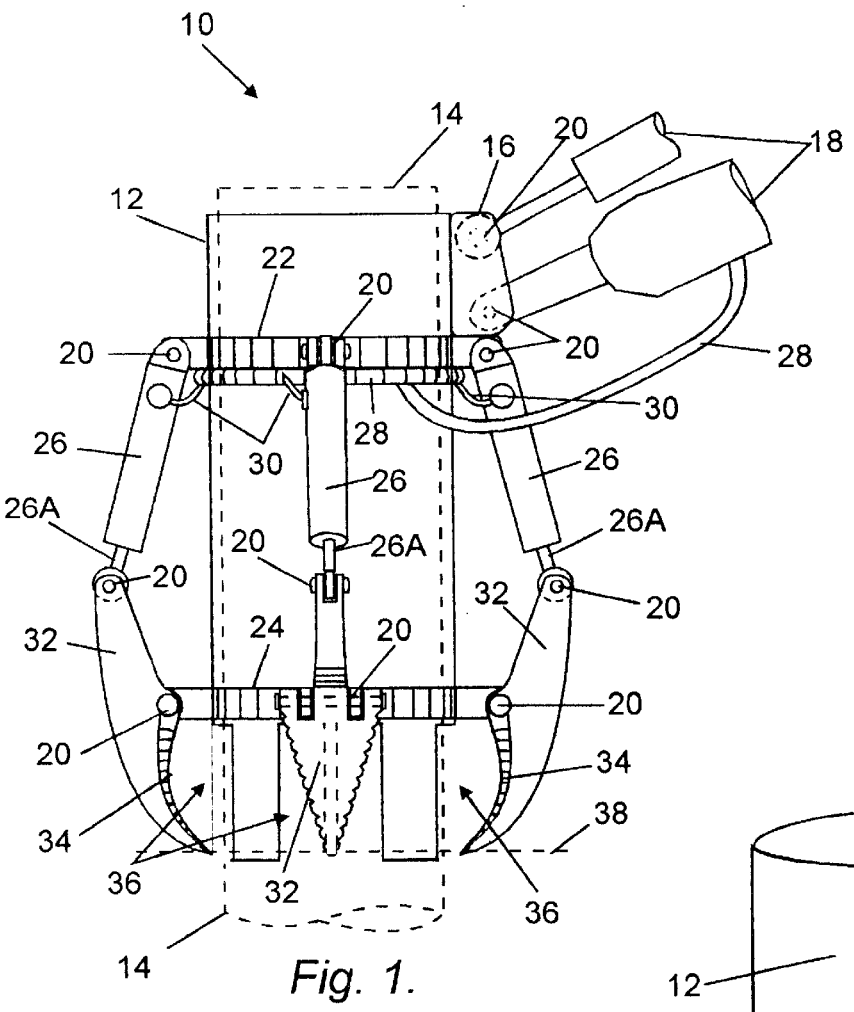
FIG. 1 showing a first embodiment of the present invention In a side elevation view illustrating the invention device for use with short pilings. The hydraulic cylinders on a cylinder ring seen at the top of a pile-fitting tube operate rocking cutters arranged pivotal around a cutter ring seen at the bottom of the tube. Openings shown in the bottom of the tube allow the cutters to pass through and shear off the piling inside the tube.
Figure 2:
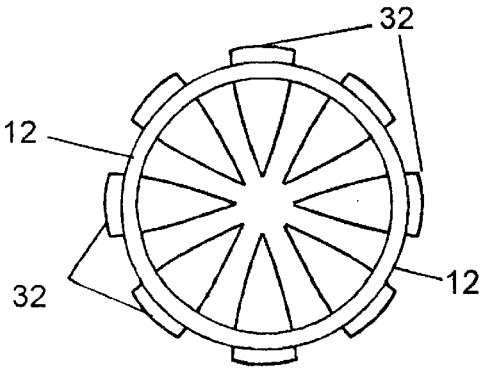
FIG. 2 Showing a top plan view of cutters as they would be positioned around a tube in a multiple cut arrangement. Cutters on this invention may vary in number depend upon the job requirement.
Figure 3:
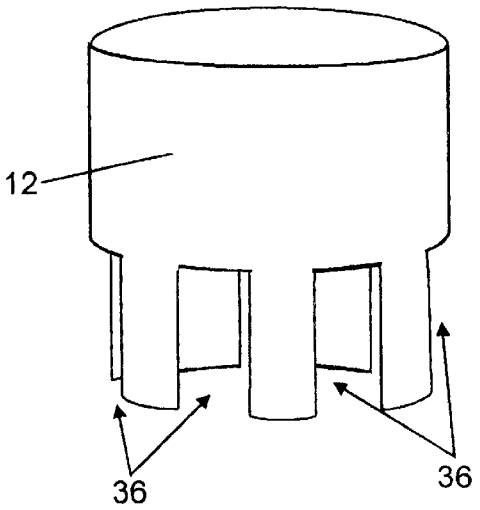

Referring now to the drawings at FIG. 1 where a first embodiment of the invention generally is referenced as invention 10. In this embodiment, a single tube 12 fits over piling 14. Attachment receiver 16 is on the side at the upper edge of tube 12 and is where back hoe attachments 18 are affixed. Back hoe attachments 18 are affixed by pivotal retainers 20 to attachment receiver 16. Cylinder support ring 22 is upwardly affixed to tube 12 and cutter support ring is downwardly affixed to tube 12. Hydraulic cylinders 26 attach by upper pivotal retainers 20 to ring 22. Cylinders 26 have their operational arms 26A attached by pivotal retainers 20 to the upper ends of rocker cutters 32. Main hydraulic feed line 28 extends free from a controlled pump unseen in an operational back hoe at attachments 18 and continues around under cylinder support ring 22. Hydraulic fluid supply to cylinders 26 is provided through cylinder hydraulic lines 30. Rocker cutters 32 are affixed to cutter support ring 24 by pivotal retainers 20. Sharpened, serrated cutting edges 34 of cutters 32 are faced towards tube 12. In this manner sharpened edges 34. pass through openings 36 in the bottom of tube 12 when cutters 32 are pushed down by cylinders 26. When a back hoe operator (or a derrick operator) activates the hydraulic system and arms 26A move downward, this causing the lower ends of cutters 32 to cut into piling 14 inside of tube 12. With tube 12 pressed into ocean or lake bottom 38 (see illustration at FIG. 1) so that piling 14 can be cut off close to bottorm 38, cylinders 26 are activated and cutters 32 cut into piling 14. With cutters 32 still engaged, cut off piling 14 can be lifted by the back hoe operator and deposited on a conveyance by reversing the hydraulic system. With cutters 32 back in the opened position, the device of invention 10 is ready for use on the next piling to be removed.

Figure 4:
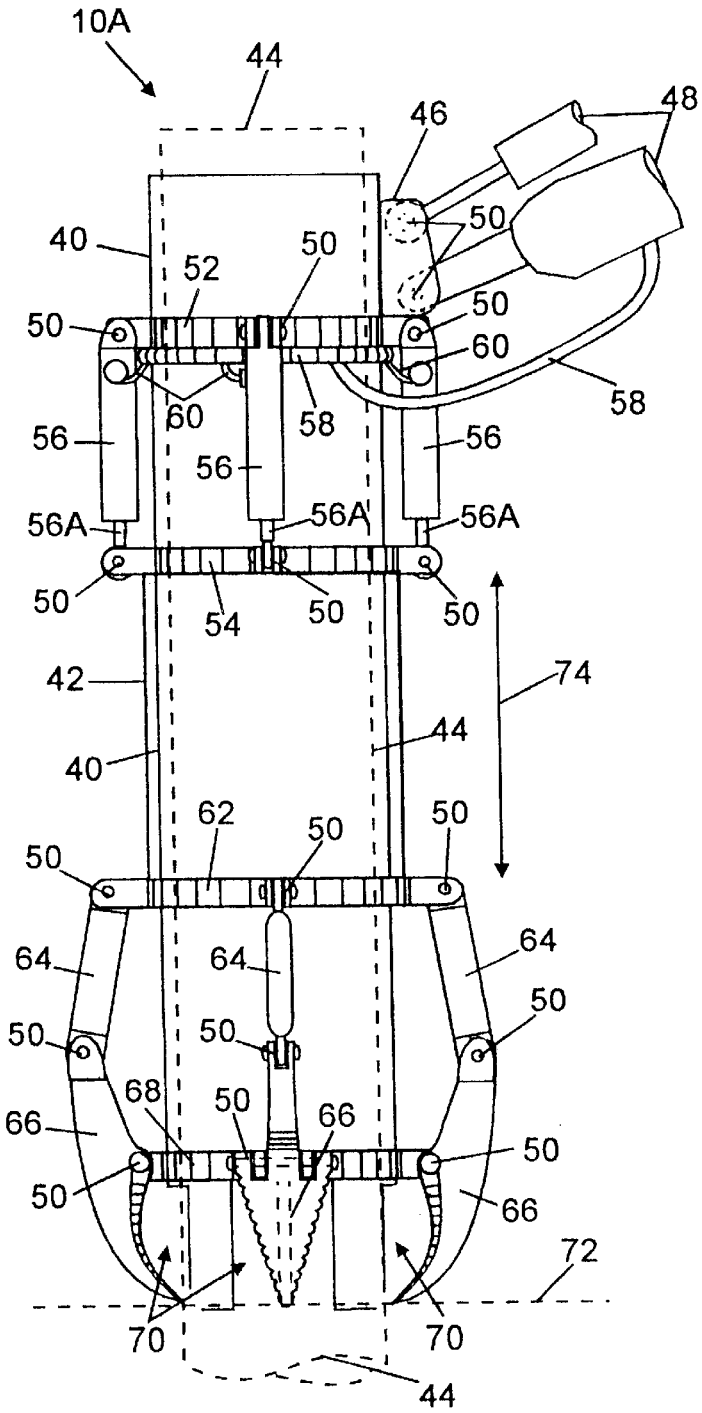
FIG. 4. showing a second embodiment of the present invention having an inner tube for encasing a piling and a sliding outer tube for operating the cutting mechanics. This embodiment is useful for longer pilings.

At FIG. 4, a second embodiment of the invention, designated invention 10A can be seen. Invention 10A is useful for cutting off and removing long pilings. Invention 10A has a long fixed inside tube 40 and a short outside slide tube 42 close-fitted over tube 40. As can be seen in the illustrations, piling 44 for removal is encased in tube 40. Tube 40 has attachment receiver 46 on one side at the top. Back hoe attachments 48 are shown affixed to receiver 46 by pivotal retainers 50. Affixed around tube 40 just below receiver 46 is cylinder support ring 52. Hydraulic cylinders 56 attach at the top to ring 52 by pivotal retainers 50 and by their cylinder arms 56A at the bottom to slider tube 40 at outer tube upper ring 54 by pivotal retainers 50. Hydraulic fluid line 58 affixes to the back hoe pump (unseen) at one end and extends around under cylinder support ring 52 connecting with cylinder hydraulic feed lines 60 at each cylinder 56. At the bottom end of slide tube 42, link support ring 62 attaches to cutter powering links 64 by pivotal retainers 50. The upper ends of cutters 66 attach to links 64 by pivotal retainers 50. Affixed at the lower end of inside tube 40 just above openings 70 is lower cutter support ring 68. Cutters 66 with sharpened ends inward are fastened to ring 68 by pivotal retainers 50 in a manner so the sharpened sides and end of cutters 66 swings inside of tube 40 through openings 70 to cut off piling 44. The lower end of tube 40 should be pressed down on ocean bottom 72 to get a close cutoff of piling 44 near bottom surface 70.

Figure 5:
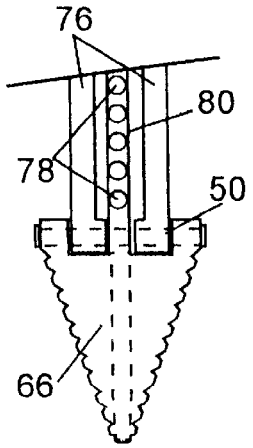
FIG. 5 showing a heavy duty cutter with dual pivotal arms affixed. The attachment fittings include a U-shaped bracket and a multiple of retainer screws.
Figure 6:
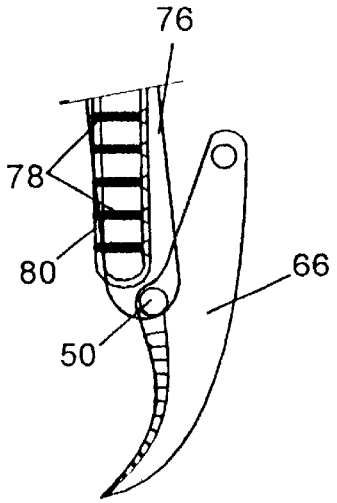
FIG. 6. showing a side view of the FIG. 5 cutter and attachments.

Heavy duty cutter 66 is illustrated in FIG. 5 and FIG. 6. Double link pivotal attachment 76 is on each side of looped support arm 80. Retainer screws 78 add strength to looped support arm 80 where heavier pile cutting equipment might be required. FIG. 5 is a frontal view of heavy duty cutter 66 and FIG. 6 is a side view of the device.

Figure 7:
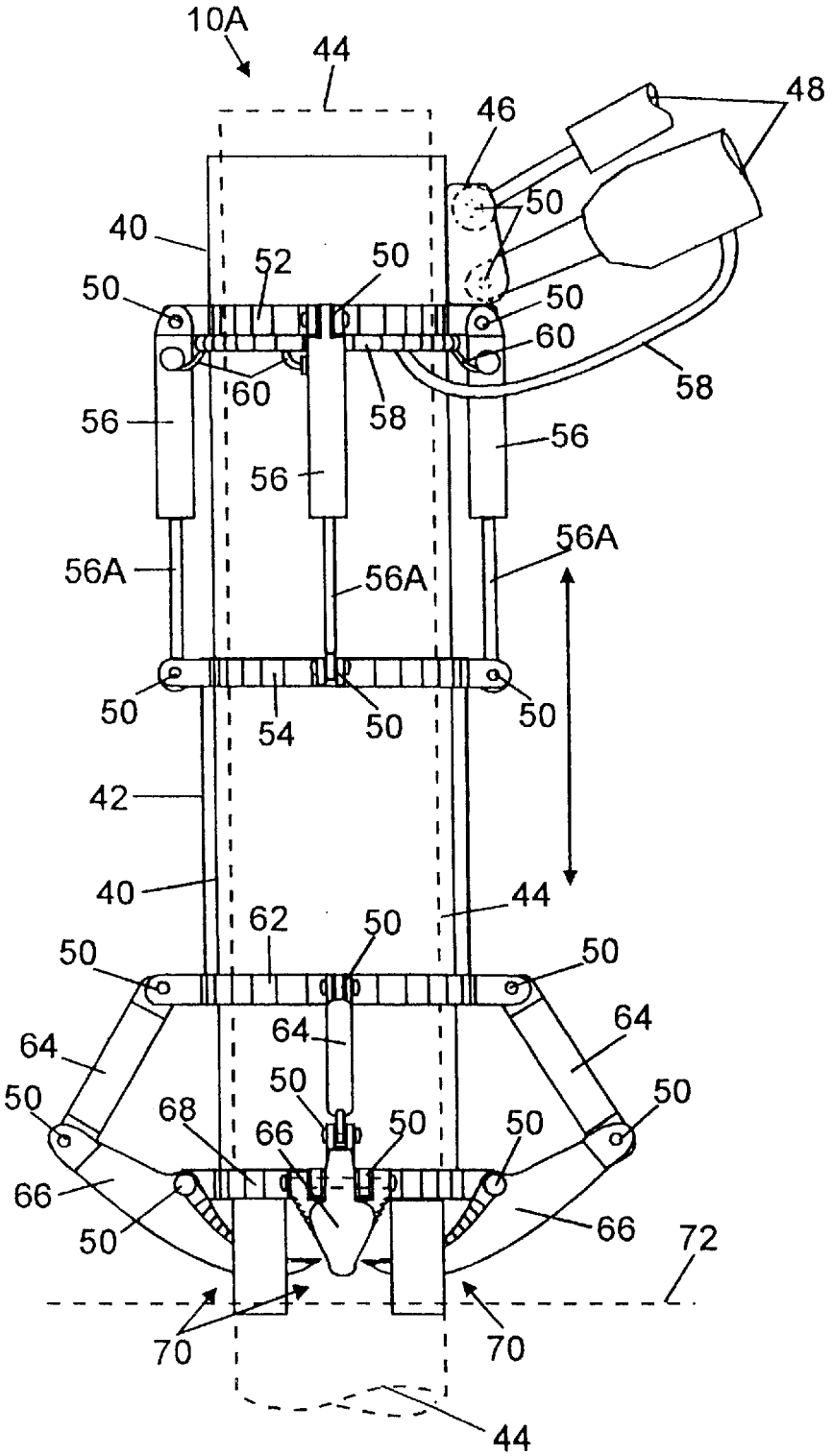
FIG. 7 showing the embodiment of FIG. 4 in the cutting position. In the drawing, hydraulic cylinders attached at the top of the inner tube have pushed the outer slide tube downward to activate cutter powering links and rock the cutter heads on the bottom ring inward to shear off the encased piling.

FIG. 7 shows the appearance of invention 10A when cylinders 56 have been pressurized. Outer slide tube 42 is pushed downward causing ring 62 to compress on ring 68. Cutter powering links 64 are pushed outward causing cutters 66 to rock over with their sharpened edges cutting into piling 44. The bottom end of tube 40 is pushed down into ocean bottom 72 and piling 44 is cut off as close to bottom 72 as possible.

Although I have described embodiments according to the invention with considerable details in the foregoing specification and illustrated them extensively in the drawings, it is to be understood that I may make changes in the structure of the devices so long as any changes made remain within the scope of the appended claims and any changed devices similar to mine made by others that fall within my claim scope, I shall consider such devices to be my invention.

What is claimed is:

1. A pile remover for a short pile having a tube body sized to fit over said pile, said tube body having an upper and a lower end, said upper end equipped for attachment to operational auxiliary equipment, said lower end equipped with at least one cutter, said cutter arranged pivotal to rock over inserting a sharpened end into said pile when activated by a powering means, said powering means affixed at a first end by attachment adjacent said upper end of said tube with said powering means affixed by a second end to an end of said cutter in a manner to cause said cutter to rock inserting said sharpened end into said pile, said powering means reversible to return said cutter to an original position, said powering means controllable by said operational auxiliary equipment, movement of said pile remover controllable by said auxiliary equipment.

2. The device of claim one wherein said powering means includes hydraulic cylinders.

3. A pile remover for a long pile having a first tube body sized to fit over said pile, said first tube body having an upper and a lower end, said upper end equipped for attachment to operational auxiliary equipment, said lower end equipped with at least one cutter, said cutter arranged pivotal to rock over inserting a sharpened end into said pile when activated by a powering means, said powering means attached at a first end adjacent said upper end of said first tube with said powering means attached by a second end to a ring affixed to an upward end of a short second tube sliding over said first tube, there being a ring around a downward end of said sliding tube with a short link thereon attached to an end of said cutter in a manner to cause said cutter to rock inserting said sharpened end into said pile when said sliding tube is forced downward, said powering means reversible to return said sliding tube and said cutter to an original position, said powering means controllable by said operational auxiliary equipment, movement of said pile remover controllable by said auxiliary equipment.

4. The device of claim three wherein said powering means includes hydraulic cylinders.

* * * * *